US008105037B2

(12) United States Patent
Grover et al.

(10) Patent No.: US 8,105,037 B2
(45) Date of Patent: Jan. 31, 2012

(54) ENDWALL WITH LEADING-EDGE HUMP

(75) Inventors: Eric A. Grover, Tolland, CT (US); Thomas J. Praisner, Colchester, CT (US); Noel Modesto-Madera, Wethersfield, CT (US); Renee J. Jurek, Manchester, CT (US)

(73) Assignee: United Technologies Corporation, Hartford, CT (US)

( * ) Notice: Subject to any disclaimer, the term of this patent is extended or adjusted under 35 U.S.C. 154(b) by 445 days.

(21) Appl. No.: 12/418,647

(22) Filed: Apr. 6, 2009

(65) Prior Publication Data

US 2010/0254797 A1 Oct. 7, 2010

(51) Int. Cl.
*F04D 29/44* (2006.01)

(52) U.S. Cl. ..... 416/193 A; 416/179

(58) Field of Classification Search ..... 416/193 A; 415/191

See application file for complete search history.

(56) References Cited

U.S. PATENT DOCUMENTS

| | | | | |
|---|---|---|---|---|
| 2,198,254 | A | 4/1940 | Koehring | |
| 4,208,167 | A | 6/1980 | Yasugahira et al. | |
| 6,283,713 | B1 | 9/2001 | Harvey et al. | |
| 6,561,761 | B1 | 5/2003 | Decker et al. | |
| 6,669,445 | B2 | 12/2003 | Staubach et al. | |
| 6,884,029 | B2 | 4/2005 | Beeck | |
| 6,969,232 | B2 | 11/2005 | Zess et al. | |
| 7,134,842 | B2 | 11/2006 | Tam et al. | |
| 7,150,427 | B1 | 12/2006 | Praisner et al. | |
| 7,220,100 | B2 * | 5/2007 | Lee et al. | 415/191 |
| 7,371,046 | B2 | 5/2008 | Lee et al. | |
| 7,625,181 | B2 * | 12/2009 | Matsuda et al. | 416/193 A |
| 2006/0275126 | A1 * | 12/2006 | Heitland et al. | 416/193 A |
| 2007/0258817 | A1 | 11/2007 | Allen-Bradley et al. | |
| 2007/0258818 | A1 | 11/2007 | Allen-Bradley et al. | |
| 2007/0258819 | A1 | 11/2007 | Allen-Bradley et al. | |
| 2010/0074763 | A1 * | 3/2010 | Liang | 416/97 R |

* cited by examiner

*Primary Examiner* — Matthew Landau
*Assistant Examiner* — Robert Bachner
(74) *Attorney, Agent, or Firm* — Carlson Gaskey & Olds, P.C.

(57) ABSTRACT

An example airfoil assembly includes a base having an airfoil projecting radially therefrom. The base extends laterally away from the airfoil. The airfoil extends axially from an airfoil leading edge portion to an airfoil trailing edge portion. The base has a humped area forward the airfoil leading edge portion.

18 Claims, 3 Drawing Sheets

ENDWALL WITH LEADING-EDGE HUMP

BACKGROUND

This application relates generally to gas turbine engine airfoil arrays. More particularly, this application relates to influencing fluid flow near the leading edge portions of the airfoils within the airfoil array.

Gas turbine engines are known and typically include multiple sections, such as a fan section, a compression section, a combustor section, a turbine section, and an exhaust nozzle section. The fan section moves air into the engine. The air is compressed in the compression section. The compressed air is mixed with fuel and is combusted in the combustor section. Products of the combustion expand to rotatably drive the engine.

Some sections of the engine include vane arrays, blade arrays, or both. Air within the engine moves through fluid flow passages in the arrays. The fluid flow passages are established by adjacent airfoils projecting from laterally extending endwalls. As known, air approaching the fluid flow passages can separate from portions of the arrays. The separation within the engine can disadvantageously increase aerodynamic losses and can contribute to locally increased convective heat loads. The separation often occurs in vane arrays or blade arrays having airfoils with low camber angles, such as some of the airfoils within the turbine section of the engine.

SUMMARY

An example airfoil assembly includes a base having an airfoil projecting radially therefrom. The base extends laterally away from the airfoil. The airfoil extends axially from an airfoil leading edge portion to an airfoil trailing edge portion. The base has a humped area forward the airfoil leading edge portion.

An example gas turbine engine assembly includes an endwall and an array of airfoils circumferentially distributed about an axis. The endwall and the airfoils establish a plurality of fluid flow passages. A plurality of convex features is circumferentially distributed about the axis. At least a portion of the convex features are positioned axially forward the fluid flow passages and is configured to influence flow through the fluid flow passages.

An example method of influencing flow within a gas turbine engine includes moving a fluid axially toward a fluid flow passage established between adjacent airfoils in a gas turbine engine. The airfoils project radially from an endwall. The method also includes limiting flow separation of the fluid near at least one of the airfoils using a hump projecting from the endwall.

These and other features of the example disclosure can be best understood from the following specification and drawings, the following of which is a brief description:

DETAILED DESCRIPTION

Figure 1:
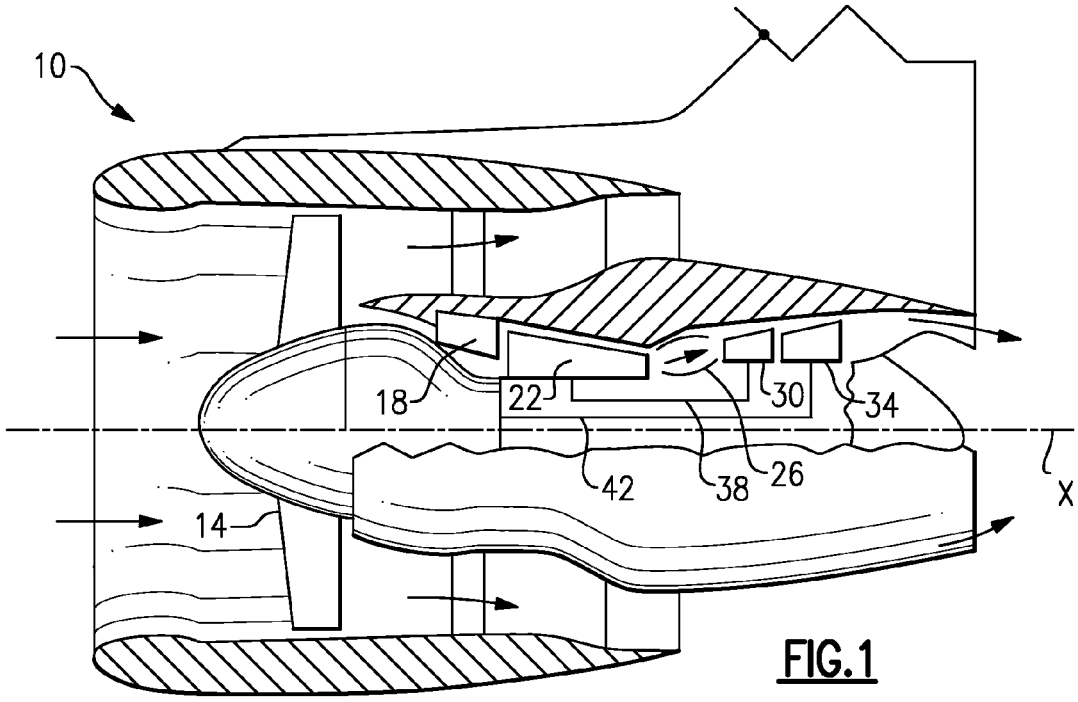
FIG. 1 shows a schematic view of an example gas turbine engine.

FIG. 1 schematically illustrates an example gas turbine engine 10 including (in serial flow communication) a fan section 14, a low-pressure compressor 18, a high-pressure compressor 22, a combustor 26, a high-pressure turbine 30, and a low-pressure turbine 34. The gas turbine engine 10 is circumferentially disposed about an engine centerline X. During operation, air is pulled into the gas turbine engine 10 by the fan section 14, pressurized by the compressors 18 and 22, mixed with fuel, and burned in the combustor 26. The turbines 30 and 34 extract energy from the hot combustion gases flowing from the combustor 26.

In a two-spool design, the high-pressure turbine 30 utilizes the extracted energy from the hot combustion gases to power the high-pressure compressor 22 through a high speed shaft 38. The low-pressure turbine 34 utilizes the extracted energy from the hot combustion gases to power the low-pressure compressor 18 and the fan section 14 through a low speed shaft 42. The examples described in this disclosure are not limited to the two-spool architecture described and may be used in other architectures, such as a single-spool axial design, a three-spool axial design, and still other architectures. That is, there are various types of engines that could benefit from the examples disclosed herein, which are not limited to the design shown.

Figure 4:
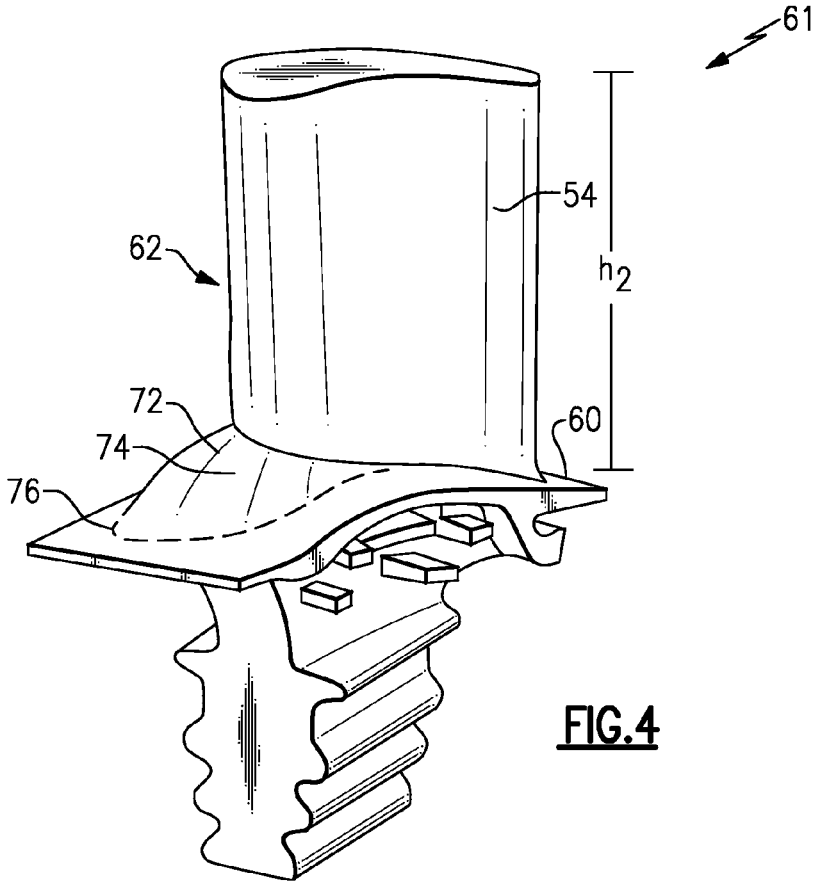
FIG. 4 shows a perspective view of an example airfoil assembly from the FIG. 2 airfoil array.
Figure 2:
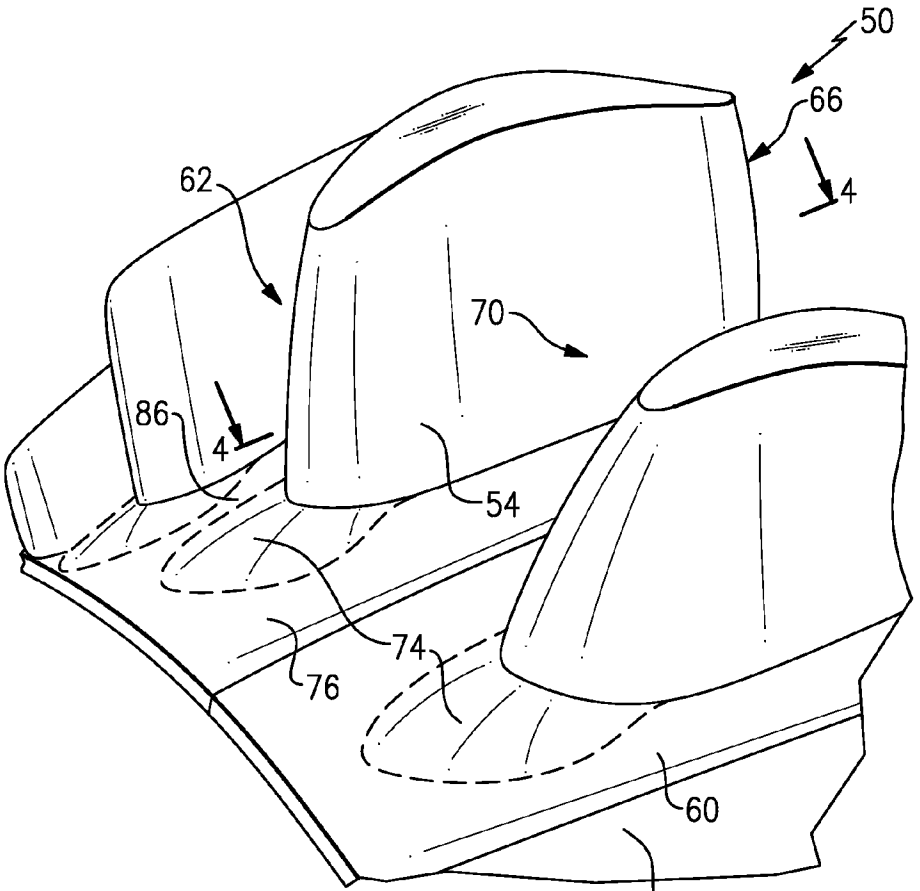
FIG. 2 shows a perspective view of an example airfoil array within the FIG. 1 engine.

Referring to FIGS. 2 and 4 with continuing reference to FIG. 1, an example airfoil array 50 includes a plurality of airfoils 54 circumferentially arranged about the engine centerline X. The airfoils 54 project radially from an endwall 58 comprised of a plurality of airfoil bases 60. The airfoil array 50 is mounted for rotation within the engine 10 about the engine centerline X. In this example, an airfoil assembly 61 includes one of the airfoils 54 and one of the bases 60. In another example, such as when the airfoils 54 are vanes, the airfoils span between two bases and are not mounted for rotation within the engine 10.

The airfoils 54 extend axially from an airfoil leading edge portion 62 to an airfoil trailing edge portion 66. Adjacent ones of the airfoils 54 establish a flow passage 70 with the endwall 58. As known, fluid flow, such as airflow, moves toward the flow passage 70 from a position forward the leading edge portion 62 of the airfoils 54 as the engine 10 operates.

Figure 3:
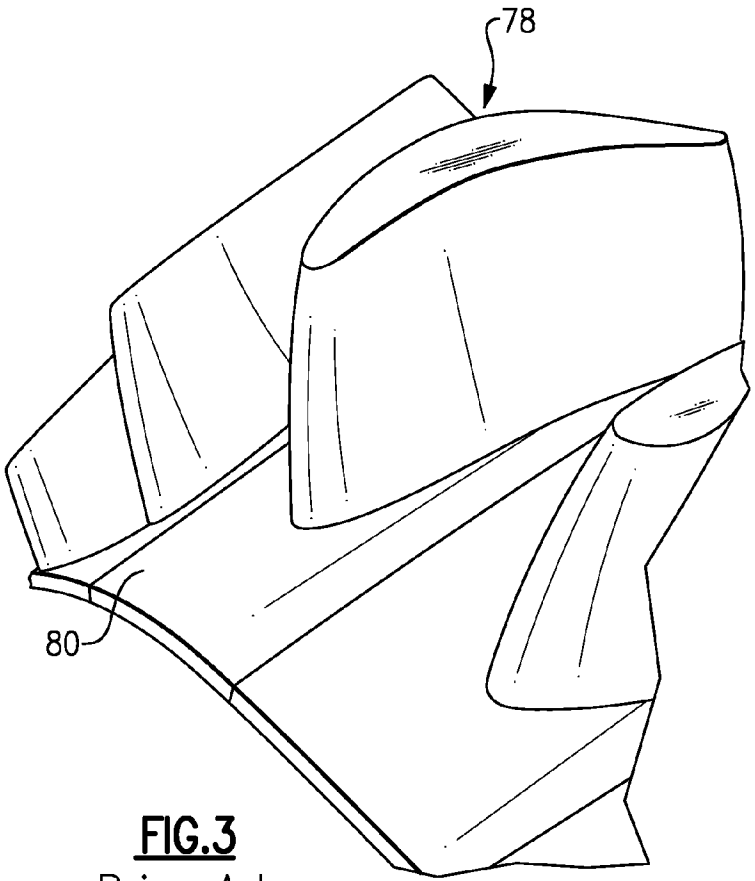
FIG.3 Prior Art
FIG. 3 shows a prior art airfoil array.

In this example, the endwall 58 includes a hump 74 extending axially forward the leading edge portions 62 of the airfoils 54 within the airfoil array 50. The example hump 74 extends radially away from the engine centerline X relative to a surface 76 of the endwall 58 adjacent the hump 74. The example airfoils 54 project radially outward from the endwall 58 having the hump 74. In another example, such as when the airfoils 54 comprise vanes, the airfoils 54 project radially inward from an endwall having the hump 74, and the hump 74 extends radially inward toward the engine centerline X. An endwall 80 in a prior art airfoil array 78 (FIG. 3) lacks the hump 74.

Figure 5:
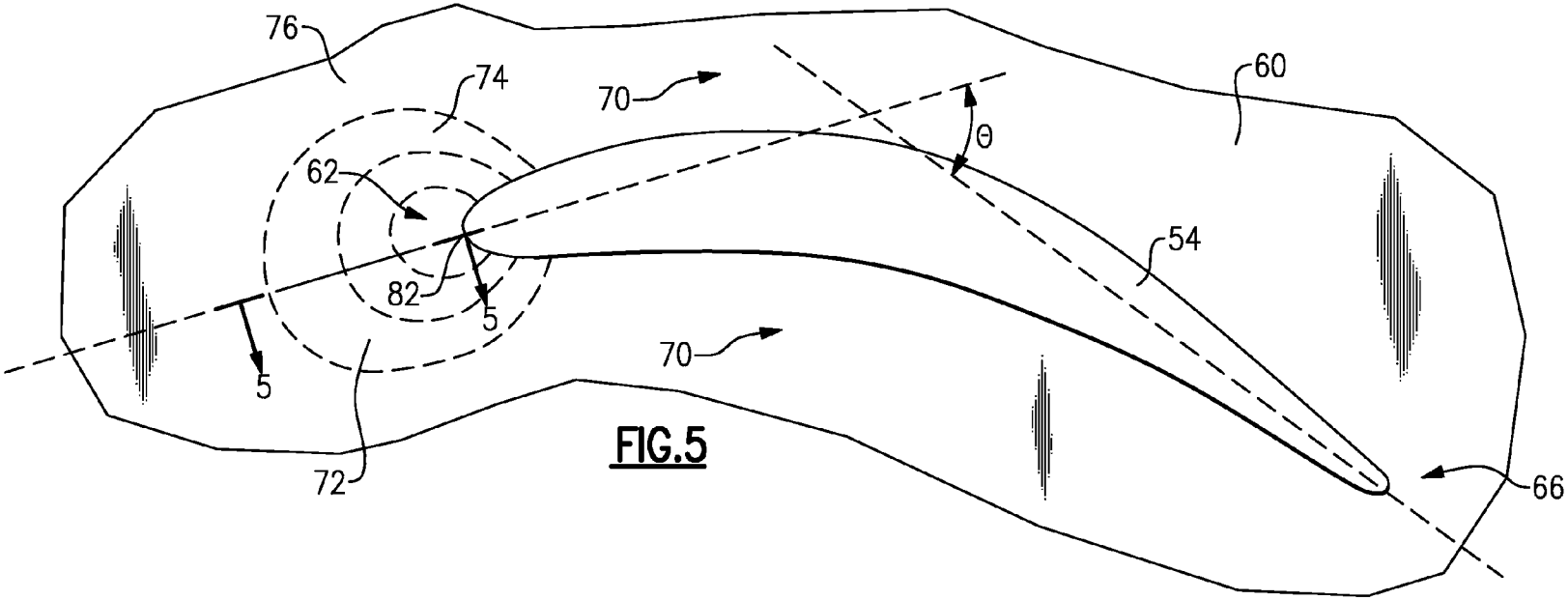
FIG. 5 shows a sectional view taken at line 5-5 of FIG. 4.
Figure 6:
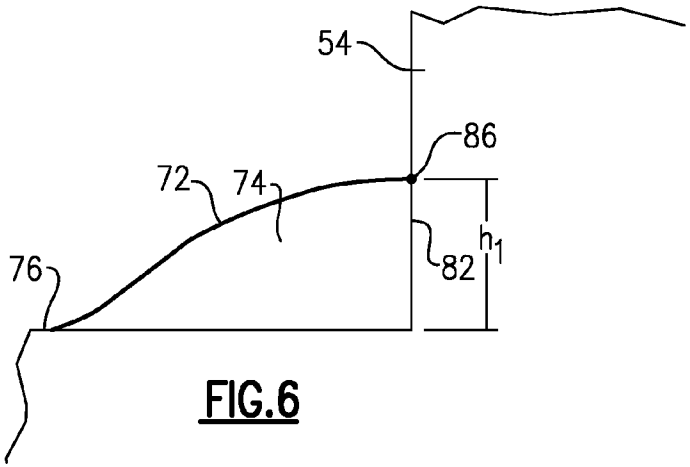
FIG. 6 shows a sectional view taken at line 6-6 of FIG. 4.

Referring now to FIGS. 5 and 6 with continued reference to FIGS. 2 and 4, a surface 72 of the hump 74 is convex in this example relative to a surface 76 of the endwall adjacent the hump 74. That is, the concavity of the surface 72 of the hump 74 projects radially inward. At least a portion of the example hump 74 is axially forward the leading edge portion 62 of the airfoil 54, which enables the hump 74 to influence flow prior to the flow entering the flow passage 70.

The example hump 74 has a radial peak 82 at an interface 86 of the hump 74 and the airfoil 54. In another example, the radial peak 82 of the hump 74 is axially forward the interface 86. Although some portions of the hump 74 extend rearward into the flow passage 70, the radial peak 82 of the hump 74 is forward the leading edge portion 62 and thus forward the flow passage 70. In yet another example, the radial peak 82 of the hump 74 is axially rearward the interface 86.

A radial height $h_1$ of the hump 74 corresponds to the distance between the surface 76 of the endwall 58 and the radial peak 82. In this example, the radial height $h_1$ of the hump 74 is between 5% and 25% the radial height $h_2$, or span, of the airfoil 54.

The example airfoil 54 is a low camber airfoil, which typically corresponds to airfoil 54 having a camber angle θ of less than 60°. In this example, the camber angle θ of the airfoil 54 is about 30°. As known, low camber airfoils, such as the airfoil 54, are particularly prone to separation of flow near the leading edge portions 62. Higher camber airfoils, however, could also benefit from the hump 74.

The example airfoil array 50 the airfoil array 50 is a turbine exit guide vane assembly. In another example, the airfoil array 50 is a mid-turbine frame component that is positioned axially between the high-pressure turbine 30 and the low-pressure turbine 34 of the engine 10 (FIG. 1). As known, mid-turbine frame components may include airfoils having 0 camber angle. In yet another example, the airfoil array 50 is a counter rotating vane assembly.

Features of the disclosed embodiments include reducing convective heat loads and improving aerodynamic performance of airfoil arrays by positioning a hump near the leading edges of airfoils within the airfoil array, and particularly the leading edges of low camber airfoils.

Although a preferred embodiment has been disclosed, a worker of ordinary skill in this art would recognize that certain modifications would come within the scope of this invention. For that reason, the following claims should be studied to determine the true scope and content of this invention.

We claim:

1. An airfoil assembly comprising a laterally extending base having an airfoil projecting radially therefrom relative to an axis, the base extending laterally away from the airfoil, the airfoil extending axially from an airfoil leading edge portion to an airfoil trailing edge portion, the base having a humped area axially forward the airfoil leading edge portion, and the humped area has a concavity that projects radially inward.

2. The airfoil assembly of claim 1 wherein the humped area has a hump surface that is convex relative to a surface of the base adjacent the humped area.

3. The airfoil assembly of claim 1 wherein the humped area has a radial peak at an interface with the airfoil leading edge portion.

4. The airfoil assembly of claim 1 wherein a radial height of the humped area decreases as the humped area extends axially forward from the leading edge portion.

5. The airfoil assembly of claim 1 wherein the airfoil extends radially a first distance and the humped area extends radially a second distance that is between 5% and 25% of the first distance.

6. The airfoil assembly of claim 1 wherein the airfoil is a low camber airfoil.

7. The airfoil assembly of claim 1 wherein the airfoil has a camber angle that is less than 60°.

8. The airfoil assembly of claim 1 wherein the airfoil and the base is configured to establish a fluid flow passage with another airfoil assembly, the humped area configured to influence flow through the fluid flow passage.

9. The airfoil assembly of claim 1 wherein a portion of the humped area extends axially rearward the airfoil leading edge portion.

10. A gas turbine engine assembly comprising an endwall;

an array of airfoils circumferentially distributed about an axis, the endwall and the airfoils establishing a plurality of fluid flow passages; and a plurality of convex features circumferentially distributed about the axis, wherein at least a portion of the convex features is positioned axially forward the fluid flow passages and is configured to influence flow through the fluid flow passages.

11. The gas turbine engine assembly of claim 10 wherein the airfoils have a camber angle that is less than 60°.

12. The gas turbine engine assembly of claim 10 wherein the airfoils extend axially between leading edge portions and trailing edge portions, and the convex features contact the leading edge portions.

13. The airfoil array of claim 10 wherein the convex features limit separation of flow adjacent the fluid flow passages.

14. The gas turbine engine assembly of claim 10 wherein the endwall comprises the convex features.

15. The gas turbine engine assembly of claim 10 wherein the plurality of convex features are circumferentially aligned with the array of airfoils.

16. A method of influencing flow within a gas turbine engine comprising moving a fluid axially toward a fluid flow passage established between adjacent airfoils in a gas turbine engine, the airfoils projecting radially from an endwall relative to a rotational axis of the gas turbine engine; and limiting flow separation of the fluid near at least one of the airfoils using a hump projecting from the endwall.

17. The method of claim 16 wherein a peak of the hump is positioned axially in front of the fluid flow passage.

18. The method of claim 16 wherein the adjacent airfoils are low camber airfoils.

* * * * *